US011013276B2

(12) United States Patent
Koller

(10) Patent No.: US 11,013,276 B2
(45) Date of Patent: May 25, 2021

(54) CLOTHING

(71) Applicant: KIDO SPORTS CO., LTD., Seoul (KR)

(72) Inventor: Robert Koller, West Bend, WI (US)

(73) Assignee: KIDO SPORTS CO., LTD., Seoul (KR)

( * ) Notice: Subject to any disclaimer, the term of this patent is extended or adjusted under 35 U.S.C. 154(b) by 110 days.

(21) Appl. No.: 16/411,280

(22) Filed: May 14, 2019

(65) Prior Publication Data

US 2020/0352259 A1 Nov. 12, 2020

(30) Foreign Application Priority Data

May 10, 2019 (KR) ..... 10-2019-0054919

(51) Int. Cl.
*A41D 27/20* (2006.01)
*A41D 13/00* (2006.01)
(Continued)

(52) U.S. Cl.
CPC ..... *A41D 13/0012* (2013.01); *A41D 1/02* (2013.01); *A41D 2300/322* (2013.01); *A41D 2400/48* (2013.01); *A41D 2600/102* (2013.01)

(58) Field of Classification Search
CPC ..... A41D 13/0012; A41D 1/02; A41D 2600/102; A41D 2300/322; A41D 2400/48; A41D 27/20; A41D 3/00; A41D 1/084; A41D 27/08; A41D 27/285; A41D 29/00; A41D 3/02; A41D 13/00; A41D 13/04;
(Continued)

(56) References Cited

U.S. PATENT DOCUMENTS 2,165,348 A 7/1939 Daiber
2,304,574 A 12/1942 Issaac
(Continued)

FOREIGN PATENT DOCUMENTS

JP 3119343 U 2/2006
KR 20130114943 A 10/2013

OTHER PUBLICATIONS

Extended European Search Report dated Sep. 11, 2020 in European Application No. 20169353.8.

*Primary Examiner* — Robert H Muromoto, Jr.
(74) *Attorney, Agent, or Firm* — Panitch Schwarze Belisario & Nadel LLP

(57) ABSTRACT

A clothing part configured to surround a human body to protect the human body; and an accommodation part connected to the clothing part and configured to provide an accommodation space which is a predetermined space in which a predetermined object is received, wherein the accommodation part may form one surface together with the clothing part as an accommodation coupling part which is a part of the accommodation part is coupled to a clothing coupling part which is a part of the clothing part in a storing portion, and may provide the accommodation space which is a space in which a predetermined object is received, together with the clothing part as the accommodation coupling part and the clothing coupling part are separated from each other and thus a portion of the clothing part and a portion of the accommodation part are spaced apart from each other in an accommodation position.

13 Claims, 9 Drawing Sheets

(51) Int. Cl.
*A41D 1/02* (2006.01)
*A41D 27/00* (2006.01)

(58) Field of Classification Search
CPC ..... A41D 1/08; A41D 1/215; A41D 27/202; A41D 27/204; A45F 3/00; A45F 5/00; A45F 3/02; A45F 3/04
See application file for complete search history.

(56) References Cited

U.S. PATENT DOCUMENTS 2,314,226 A * 3/1943 Lee ..... A41D 27/10 2/94
2,573,063 A * 10/1951 Renz ..... A45C 1/08 150/136
2,837,185 A * 6/1958 Guenther ..... G09F 5/02 190/111
3,354,470 A * 11/1967 Allen ..... A41D 13/0012 2/94
4,068,314 A 1/1978 Yellen et al.
4,079,467 A * 3/1978 Baldwin ..... A41D 3/00 2/94
4,523,678 A * 6/1985 Fox ..... A47G 25/54 190/102
4,523,914 A * 6/1985 Faulconer ..... B63C 11/08 441/106
4,691,469 A * 9/1987 Alsobrook ..... A01K 97/06 206/315.11
4,736,839 A * 4/1988 King ..... A45C 3/004 206/287.1
4,791,681 A * 12/1988 Dean ..... A41D 13/012 2/102
4,854,432 A * 8/1989 Carpenter ..... A45C 13/02 190/110
5,394,565 A * 3/1995 Stewart ..... A41D 11/00 2/108
5,784,719 A 7/1998 Robinson
5,870,777 A * 2/1999 Hans ..... A41D 1/08 2/238
6,151,715 A * 11/2000 Doherty ..... A41D 13/1245 2/102
6,296,165 B1 * 10/2001 Mears ..... A45C 3/00 150/107
6,305,587 B1 * 10/2001 Miller ..... A45C 7/0068 224/153
6,363,538 B1 * 4/2002 Davis ..... A41D 1/08 2/247
6,558,062 B1 * 5/2003 Wyant ..... A45C 7/0068 206/425
6,691,323 B2 * 2/2004 Widmer ..... A41D 27/20 2/247
6,839,907 B2 * 1/2005 Katz ..... A41D 13/04 2/48
7,223,016 B2 * 5/2007 Bell ..... B65D 33/007 383/120
8,505,118 B2 * 8/2013 Bang ..... A41D 27/20 2/227
9,119,448 B1 * 9/2015 Hirshberg ..... A45C 13/001
9,301,556 B2 * 4/2016 Koller ..... A41D 3/02
10,092,137 B1 * 10/2018 Nelson ..... A47J 41/0066
2002/0125156 A1 * 9/2002 King ..... A45C 13/02 206/320
2003/0109186 A1 * 6/2003 Steger ..... B63C 9/115 441/88
2003/0172442 A1 * 9/2003 Widmer ..... A41D 27/20 2/247
2004/0118731 A1 * 6/2004 Zivic ..... B42F 7/08 206/425
2004/0134813 A1 * 7/2004 Domotor ..... A45C 3/02 206/320
2004/0237166 A1 * 12/2004 Holden ..... A45C 1/04 2/69
2005/0194273 A1 * 9/2005 Frankeny ..... A45C 1/06 206/311
2007/0102460 A1 * 5/2007 Lottman ..... A45C 7/0059 224/153
2008/0066212 A1 * 3/2008 Holden ..... A45C 1/04 2/69
2008/0120769 A1 5/2008 Gollin
2011/0072556 A1 * 3/2011 Bang ..... A41D 27/08 2/227
2011/0212280 A1 * 9/2011 Rapp ..... A41D 27/204 428/34.1
2013/0047312 A1 2/2013 Wilson
2014/0196192 A1 * 7/2014 Koller ..... A41D 3/00 2/85
2014/0209493 A1 * 7/2014 Hale ..... A45C 3/004 206/281
2015/0096097 A1 * 4/2015 Soon-Osberger ..... A41D 15/04 2/69
2015/0265020 A1 * 9/2015 McCue ..... A45C 13/03 206/216

* cited by examiner

CLOTHING

CROSS-REFERENCE TO RELATED APPLICATIONS

This application claims priority under 35 U.S.C. § 119(b) to Korean Application No. 10-2019-0054919, filed May 10, 2019, the disclosures of each of which are incorporated herein by reference.

BACKGROUND

1. Field of the Invention

The present disclosure relates to clothing, and more specifically, to clothing integrated with a bag.

2. Discussion of Related Art

Motorcycles are a means of transportation distinct from automobiles, and have characteristics different from automobiles in the aspects of convenience, mobility, and economy, and thus are loved by many people. However, since motorcycles are somewhat more dangerous than automobiles, motorcycle riders require more safety equipment. As an example, a helmet is a protective device configured to protect the head, and is required to be worn in almost every country when a motorcycle is ridden. A jacket for a motorcycle rider may exist as another protective device. The jacket for a motorcycle rider is a protective device capable of efficiently protecting the upper body of the motorcycle rider from accidents, and is a protective device configured to maintain the absolute safety of the motorcycle rider together with the helmet. However, a conventional jacket for a motorcycle rider is clothing that can only be worn while a motorcycle is ridden, and thus is not cost effective and, unlike helmets, has not been adopted by many motorcycle riders. To solve this, a jacket that has other uses in addition to being protective equipment has been developed, and among these, a jacket for a motorcycle rider integrated with a bag has been developed.

However, since a conventional jacket integrated with a bag ("Backpack clothing," Laid-Open Patent No. 10-2015-0162727, May 29, 2017) can only be converted from a backpack to a jacket or from a jacket to a backpack, and cannot be used as a backpack when worn as a jacket, the inconvenience that simultaneous use as a jacket and a backpack is impossible when a motorcycle is ridden is caused.

SUMMARY OF THE INVENTION

The present disclosure is directed to clothing that can also be used as a backpack while being worn.

However, a problem desired to be solved by the present disclosure is not limited to the above-described problem, and problems which are not mentioned may be apparently understood by those skilled in the art from the specification and the accompanying drawings.

According to an aspect of the present disclosure, there is provided clothing including: a clothing part configured to surround a human body to protect the human body; and an accommodation part connected to the clothing part and configured to provide an accommodation space which is a predetermined space in which a predetermined object is received, wherein the accommodation part forms one surface together with the clothing part as an accommodation coupling part which is a part of the accommodation part is coupled to a clothing coupling part which is a part of the clothing part in a storing portion, and provides the accommodation space which is a space in which a predetermined object is received, together with the clothing part as the accommodation coupling part and the clothing coupling part are separated from each other and thus a portion of the clothing part and a portion of the accommodation part are spaced apart from each other in an accommodation position.

Further, the clothing part may include a left arm part providing a predetermined space into which a left arm of a user is insertable, a right arm part providing a predetermined space into which a right arm of the user is insertable, and a backplate part connected to the left arm part and the right arm part and configured to surround a back of a human. The backplate part may include a first backplate part providing a predetermined area, a second backplate part providing a predetermined area, a third backplate part disposed between the first backplate part and the second backplate part to be connected to the first backplate part and the second backplate part, and the clothing coupling part connected to a portion to which the first backplate part and the third backplate part are connected and a portion to which the second backplate part and the third backplate part are connected. The accommodation part may form one surface together with the first backplate part and the second backplate part as the accommodation coupling part and the clothing coupling part are coupled to each other in the storing position, and provide the accommodation space together with the third backplate part as the accommodation coupling part and the clothing coupling part are separated from each other in the accommodation position.

In addition, the accommodation part may partially come into close contact with the third backplate part in the storing position.

In addition, the accommodation part may include a base part, one side surface portion connected to one side of the base part and one side of the third backplate part, the other side surface portion connected to the other side of the base part and the other side of the third backplate part, and the accommodation coupling part connected to the one side and the other side of the base part, and the one side surface portion and the other side surface portion may be disposed between the base part and the third backplate part to be concealed from the outside when the accommodation part is in the storing position.

In addition, the clothing may further include a space adjusting part connected to the one side surface portion or the other side surface portion to change the accommodation space according to a purpose of a user when the accommodation part is in the accommodation position, wherein the space adjusting part may include a first space adjusting part connected to the one side surface portion and a second space adjusting part spaced apart from the first space adjusting part and connected to the one side surface portion, and the first space adjusting part may be detachable from the second space adjusting part to change the accommodation space according to the purpose of the user.

In addition, the accommodation part may include a base part, one side surface portion connected to one side of the base part and one side of the third backplate part, the other side surface portion connected to the other side of the base part and the other side of the third backplate part, and the accommodation coupling part connected to the one side and the other side of the base part. The base part may be disposed so that one end portion of the base part may be fixed to the third backplate part and the other end portion of the base part may be spaced apart from the third backplate part so that a separation distance between the base part and the third backplate part may gradually increase from the one end portion of the base part toward the other end portion of the base part when the accommodation part is in the accommodation position.

In addition, the clothing may further include an external force providing part connected to the third backplate part to provide a pulling external force to the third backplate part so that drooping of the third backplate part due to the accommodation part may be prevented when an object is accommodated in the accommodation space.

In addition, the external force providing part may include a first external force providing part of which one end portion is connected to one side of an inner surface of the third backplate part, and a second external force providing part of which one end portion is connected to the other side of the inner surface of the third backplate part and the other end portion is detachable from the other end portion of the first external force providing part.

In addition, the clothing part may further include a right chest part connected to the right arm part and one side of the backplate part to surround one side of a chest and a belly of the human. One side insertion hole into which the first external force providing part is inserted may be formed in the right chest part so that a middle end portion of the first external force providing part having one end portion fixed to the inner surface of the third backplate part may be concealed in the right chest part to minimize contact between the first external force providing part and the human.

In addition, a right through hole into which the first external force providing part is inserted may be formed in the right chest part so that the other end portion of the first external force providing part may be exposed to the outside to be easily attached to and detached from the other end portion of the second external force providing part in a state in which the one end portion of the first external force providing part is fixed to the inner surface of the third backplate part and the middle end portion of the first external force providing part is concealed in the right chest part.

In addition, the clothing may further include a main cover part connected to the third backplate part and configured to surround the opening of the accommodation part opened in one direction so that a predetermined object accommodated in the accommodation space is concealed from the outside in a state in which the accommodation part is in the accommodation position. The accommodation part may include a base part, one side surface portion connected to one side of the base part and one side of the third backplate part, the other side surface portion connected to the other side of the base part and the other side of the third backplate part, and the accommodation coupling part connected to the one side and the other side of the base part, and the main cover part may be disposed between the base part and the third backplate part to be concealed from the outside when the accommodation part is in the storing position.

In addition, the clothing part may further include a first sub cover part having one end portion connected to the third backplate part to surround the other end portion of the base part, when the accommodation part is in the storing position, so that the other end portion thereof may be freely movable.

In addition, the clothing may further include a separation restricting part couplable to the main cover part to prevent separation of the main cover part from the base part by a predetermined distance or more when the main cover part surrounds the opening of the accommodation part. The separation restricting part may be connected to an inner surface of the base part facing the third backplate part to be concealed from the outside.

In addition, a through hole which is a predetermined hole may be formed in the base part so that a portion of the separation restricting part may be disposed at the outside and a portion of the main cover part may surround the opening to partially include an outer surface of the base part opposite the inner surface of the base part.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1A:
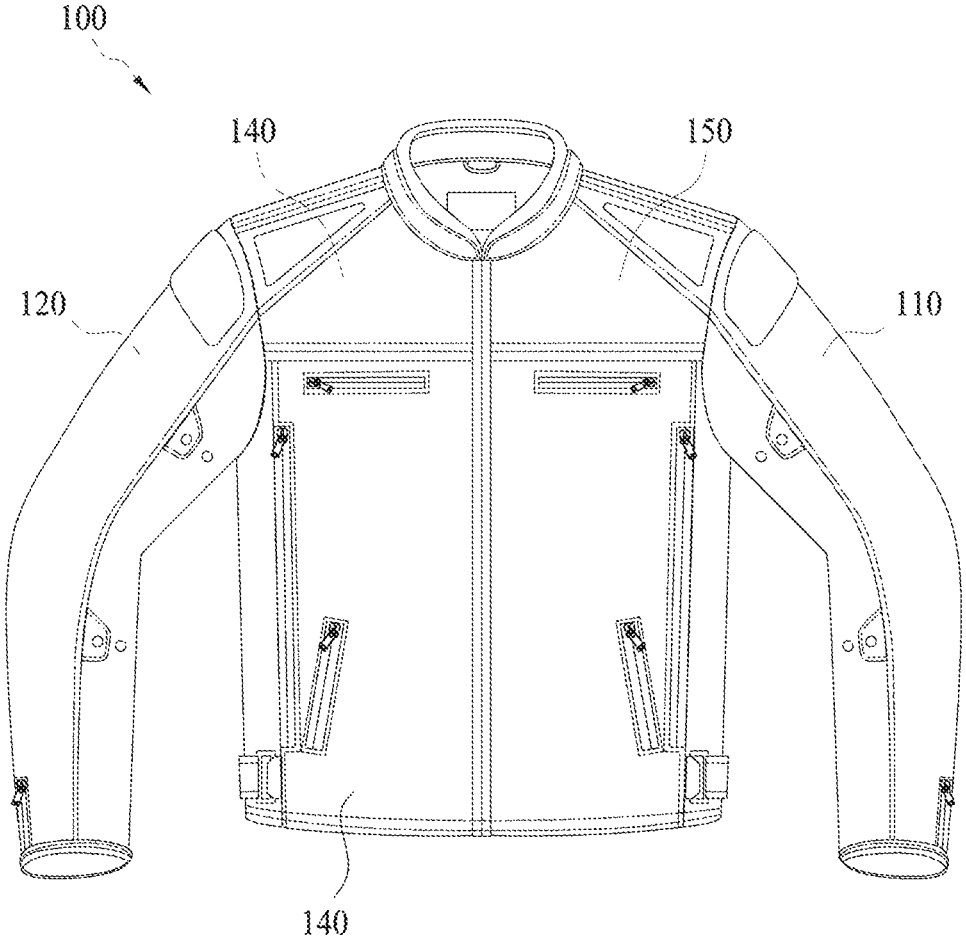
FIGS. 1A and 1B are overall perspective views of clothing according to an embodiment of the present disclosure.

Hereinafter, specific embodiments of the present disclosure will be described in detail with reference to the accompanying drawings. However, the spirit of the present disclosure is not limited to the embodiments, and those skilled in the art may easily provide other regressive disclosures or other embodiments included in the scope of the spirit of the present disclosure, but above will be also within the scope of the spirit of the present disclosure.

Further, elements having the same function within the same scope of the spirit shown in the drawings of the embodiments are described using the same reference numerals.

In the specification, when specific descriptions of known configurations or functions related to the present disclosure are determined to obscure principles of the present disclosure, detailed descriptions of the above will be omitted.

Figure 1B:
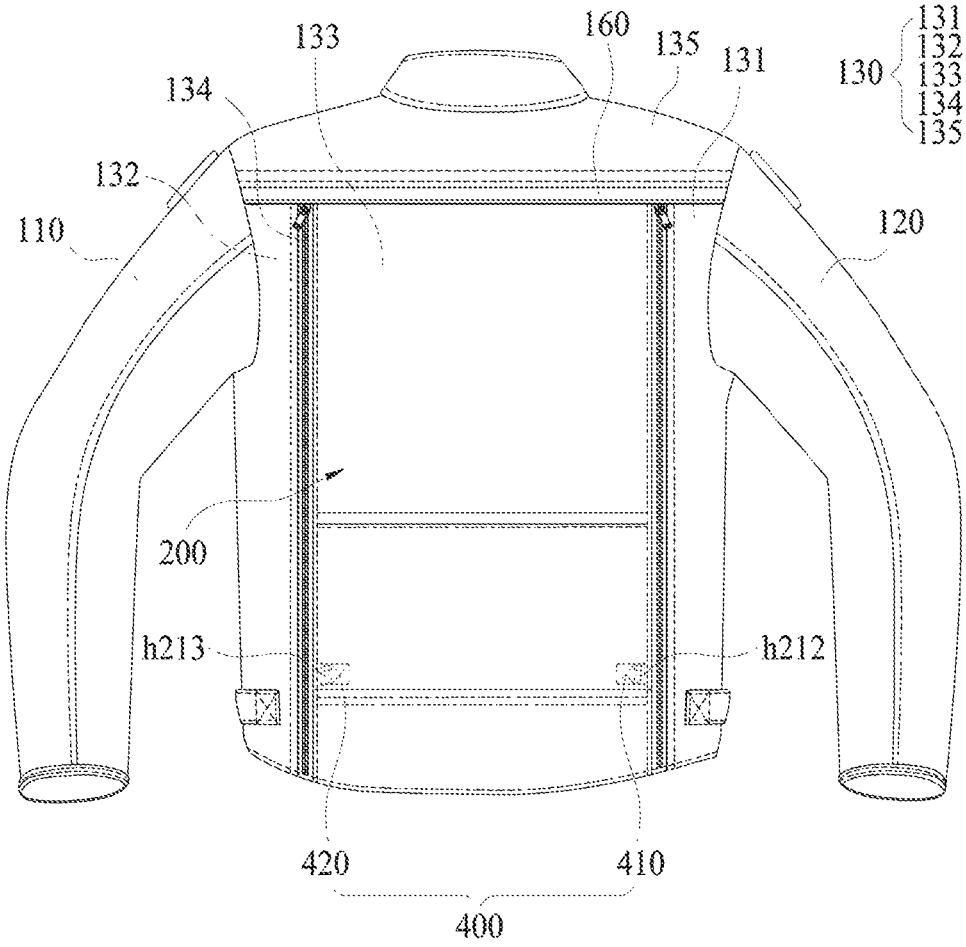
Figure 2:
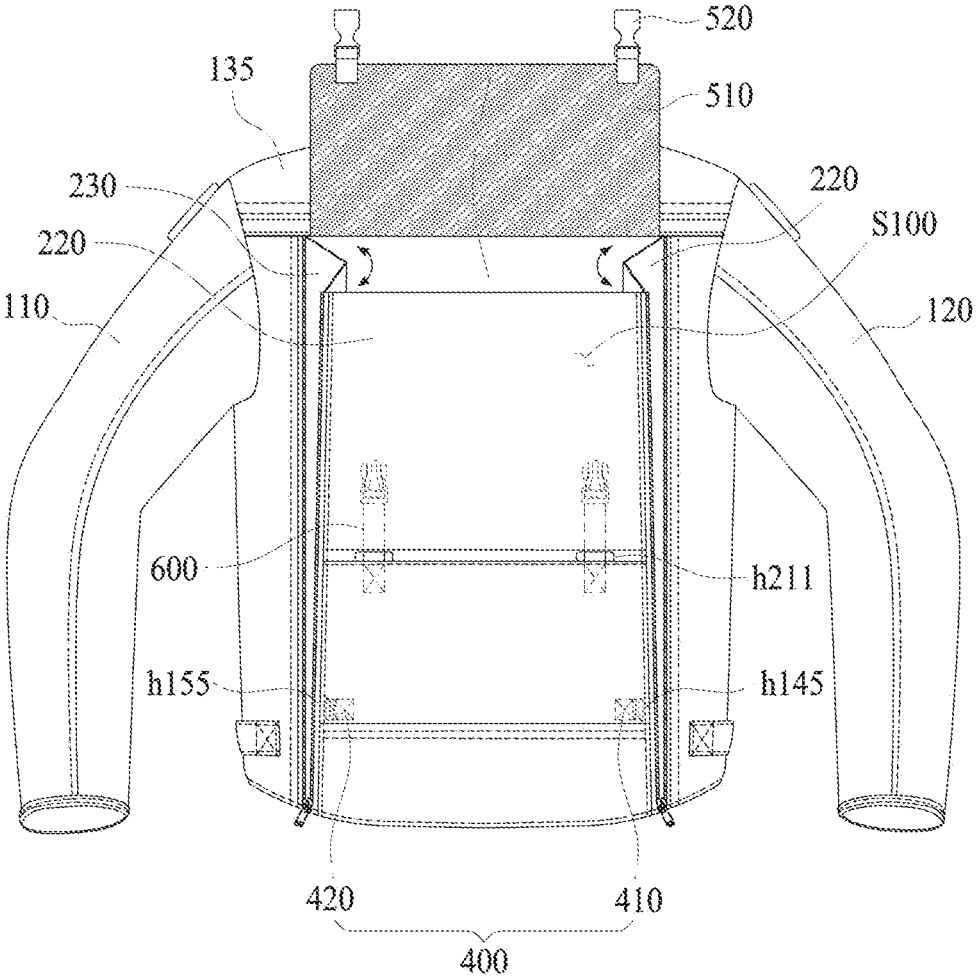
FIG. 2 is an exploded perspective view of the clothing according to an embodiment of the present disclosure.

FIGS. 1A and 1B are overall perspective views of clothing according to an embodiment of the present disclosure, and FIG. 2 is an exploded perspective view of the clothing according to an embodiment of the present disclosure.

Referring to FIGS. 1A, 1B, and 2, the clothing according to the embodiment of the present disclosure may include a clothing part 100 configured to surround a human body to protect the human body and an accommodation part 200 connected to the clothing part 100 and providing an accommodation space S100 which is a predetermined space in which a predetermined object is received.

Here, when the accommodation part 200 is in a storing position, since an accommodation coupling part 240 which is a part of the accommodation part 200 is coupled to a clothing coupling part 134 which is a part of the clothing part 100, the accommodation part 200 may form one surface together with the clothing part 100.

Further, when the accommodation part 200 is in an accommodation position, since the accommodation coupling part 240 and the clothing coupling part 134 are separated from each other, and thus a portion of the clothing part 100 and a portion of the accommodation part 200 are spaced apart from each other, the accommodation part 200 may provide the accommodation space S100, which is a space in which a predetermined object is received, together with the clothing part 100.

In addition, when the accommodation part 200 is in the accommodation position, the clothing may further include a space adjusting part 300 connected to one side surface portion 220 or the other side surface portion 230, which will be described later, to change the accommodation space S100 according to a purpose of a user.

In addition, when an object is accommodated in the accommodation space, the clothing may further include an external force providing part 400 connected to a third backplate part 133 to provide a pulling external force to the third backplate part 133 so that drooping of the third backplate part 133 due to the accommodation part 200 may be prevented.

In addition, the clothing may further include a main cover part 500 connected to the third backplate part 133 and configured to surround an opening of the accommodation part 200 opend in one direction so that the predetermined object accommodated in the accommodation space S100 is concealed from the outside in a state in which the accommodation part 200 is in the accommodation position.

In addition, the clothing may further include a separation restricting part 600 couplable to the main cover part 500 to prevent separation of the main cover part 500 from the base part 210 by a predetermined distance or more when the main cover part 500 surrounds the opening of the accommodation part 200.

The clothing part 100 is configured to surround a human body, and may include a left arm part 110 providing a predetermined space into which a left arm of a wearer is insertable, a right arm part 120 providing a predetermined space into which a right arm of the wearer is insertable, a backplate part 130 connected to the left arm part 110 and the right arm part 120 and configured to surround a back of a human, a right chest part 140 connected to the right arm part 120 and one side of the backplate part 130 to surround one side of a chest and a belly of the human, and a left chest part 150 connected the left arm part 110 and the other side of the backplate part 130 to surround the other side of the chest and the belly of the human.

Further, In addition, the clothing part 100 may further include a first sub cover part 160 having one end portion connected to the third backplate part 133 to surround the other end portion of the base part 210 when the accommodation part 200 is in the storing position, so that the other end portion thereof may be freely movable.

The backplate part 130 may include a first backplate part 131 providing a predetermined area, a second backplate part 132 providing a predetermined area, a third backplate part 133 disposed between the first backplate part 131 and the second backplate part 132 to be connected to the first backplate part 131 and the second backplate part 132, a clothing coupling part 134 connected to a portion to which the first backplate part 131 and the third backplate part 133 are connected and a portion to which the second backplate part 132 and the third backplate part 133 are connected, and a middle backplate part 135 connected to all of upper ends of the first backplate part 131, the second backplate part 132, and the third backplate part 133.

The first backplate part 131 may at least partially surround a right back plate of the wearer as the backplate part 130 connected to the right arm part 120.

The second backplate part 132 may at least partially surround a left back plate of the wearer as the backplate part 130 connected to the left arm part 110.

The third backplate part 133 may be disposed between the first backplate part 131 and the second backplate part 132 to be connected to the first backplate part 131 and the second backplate part 132.

In other words, one side of the third backplate part 133 may be connected to the first backplate part 131 and the other side of the third backplate part 133 may be connected to the second backplate part 132.

The third backplate part 133 may at least partially surround a middle backplate of the wearer.

One side portion of the middle backplate part 135 may be connected to the right arm part 120 and the other side portion of the middle backplate part 135 may be connected to the left arm part 110.

The first sub cover part 160, which will be described later, may also be connected to the middle backplate part 135.

The first sub cover part 160 may be connected to the upper ends of the first backplate part 131, the second backplate part 132, and the third backplate part 133.

When the accommodation part 200 is in the storing position, the first sub cover part 160 may cover the other end portion of the base part 210 so that the other end of the base part 210 is not exposed to the outside.

The main cover part 500 may include a major main body part 510 connected to the third backplate part 133 to be capable of at least partially surrounding an opening, which will be described later, and a major fastening part 520 which is fixed to the major main body part 510 and may be fastened to the separation restricting part 600.

The major main body part 510 may provide a predetermined area.

As an example, the major main body part 510 may have a rectangular plate shape having a predetermined thickness.

However, the present disclosure is not limited thereto, and the shape of the major main body part 510 may be variously modified at a level that is obvious to a person skilled in the art.

One end portion of the major main body part 510 may be connected to an upper side portion of the third backplate part 133.

However, the present disclosure is not limited thereto, and the position of the major main body part 510 may be variously modified at a level that is obvious to a person skilled in the art.

As an example, one end portion of the major main body part 510 may be connected to the middle backplate part 135.

One end portion of the major fastening part 520 may be fixed to the other end portion of the major main body part 510.

The other end portion of the major fastening part 520 may be coupled to a separating and fastening part of the separation restricting part 600, which will be described later.

Figure 3:
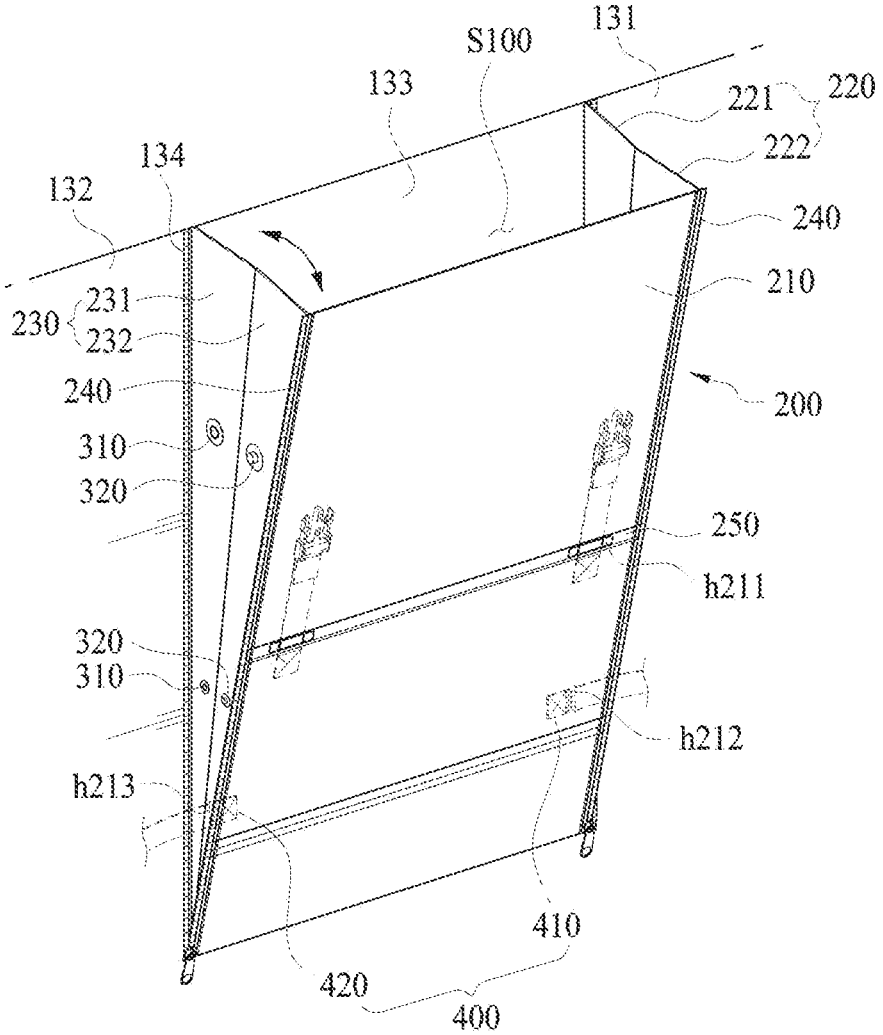
FIG. 3 is a view illustrating an accommodation part provided in the clothing according to an embodiment of the present disclosure.

FIG. 3 is a view illustrating the accommodation part provided in the clothing according to an embodiment of the present disclosure.

Referring to FIG. 3, the accommodation part 200 may include the base part 210, the one side surface portion 220 connected to one side of the base part 210 and one side of the third backplate part 133, the other side surface portion 230 connected to the other side of the base part 210 and the other side of the third backplate part 133, and the accommodation coupling part 240 connected to one side and the other side of the base part 210.

Further, the accommodation part 200 may further include a second sub cover part 250 connected to an outer surface of the base part 210 to conceal a through hole h211 which will be described later.

The one side surface portion 220, the other side surface portion 230, the base part 210, and the third backplate part 133 may provide the accommodation space S100.

The base part 210 may be a plate shape providing a predetermined area and having a predetermined thickness.

One end portion of the base part 210 (a lower end portion of the base part 210) may be fixed to the third backplate part 133.

The other end portion of the base part 210 (an upper end portion of the base part 210) may either come into contact with or be spaced apart from the third backplate part 133.

In other words, the other end portion of the base part 210 may rotate with respect to one end portion of the base part 210.

The through hole h211, which is a predetermined hole, may be formed in the base part 210.

The one side surface portion 220 may include a first one side surface portion 221 connected to the third backplate part 133 and a second one side surface portion 222 connected to both the first one side surface portion 221 and one side of the base part 210.

The other side surface portion 230 may include a first other side surface portion 231 connected to the third backplate part 133 and a second other side surface portion 232 connected to both the first other side surface portion 231 and the other side of the base part 210.

When the accommodation part 200 is in the storing position, outer surfaces of the first one side surface portion 221 and the second one side surface portion 222 may come into contact with each other.

In other words, when the accommodation part 200 is in the storing position, the one side surface portion 220 may be folded.

Likewise, when the accommodation part 200 is in the storing position, outer surfaces of the first other side surface portion 231 and the second other side surface portion 232 may come into contact with each other.

In other words, when the accommodation part 200 is in the storing position, the other side surface portion 230 may be folded.

The accommodation coupling part 240 connected to one side of the base part 210 and the clothing coupling part 134 connected to the first backplate part 131 and the third backplate part 133 may be coupled to or spaced apart from each other.

As an example, the accommodation coupling part 240 connected to one side of the base part 210 and the clothing coupling part 134 connected to the first backplate part 131 and the third backplate part 133 may be coupled to each other with a zipper.

However, the present disclosure is not limited thereto, and a method of coupling the accommodation coupling part 240 connected to one side of the base part 210 and the clothing coupling part 134 connected to the first backplate part 131 and the third backplate part 133 may be variously modified at a level that is obvious to a person skilled in the art.

Likewise, the accommodation coupling part 240 connected to the other side of the base part 210 and the clothing coupling part 134 connected to the second backplate part 132 and the third backplate part 133 may be coupled to or spaced apart from each other, and a detailed description thereof may be omitted when contents overlap the above-described contents.

The second sub cover part 250 may be connected to the outer surface of the base part 210.

The second sub cover part 250 may be connected to the base part 210 over an entire width of the base part 210.

The second sub cover part 250 may cover the through hole h211.

The second sub cover part 250 may efficiently prevent a case in which the through hole h211 is exposed to the outside, and thus foreign substances are inserted into the accommodation space S100 through the hole h211, or the object in the accommodation space S100 is discharged through the through hole h211.

The space adjusting part 300 may include a first space adjusting part 310 connected to the outer surface of the first one side surface portion 221 and a second space adjusting part 320 connected to the outer surface of the second one side surface portion 222.

When the first space adjusting part 310 and the second space adjusting part 320 are coupled to each other, the size of the accommodation space S100 may become much smaller in comparison with the case in which the first space adjusting part 310 and the second space adjusting part 320 are not coupled to each other. The first space adjusting part 310 may be attached to and detached from the second space adjusting part 320 to change the accommodation space S100 according to a purpose of a user.

The first space adjusting part 310 and the second space adjusting part 320 may either be coupled to each other or separated from each other.

When the accommodation part 200 is in the storing position, the first space adjusting part 310 and the second space adjusting part 320 may be coupled to each other, and accordingly, a folding shape of each of the first one side surface portion 221 and the second other side surface portion 232 may be maintained.

A plurality of space adjusting parts 300 may be spaced apart from each other to be connected to the one side surface portion 220.

Likewise, the space adjusting part 300 may be connected to the other side surface portion 230.

As an example, the first space adjusting part 310 may be connected to the outer surface of the first other side surface portion 231, and the second space adjusting part 320 may be connected to the outer surface of the second other side surface portion 232.

A detailed description thereof may be omitted when the contents overlap the above-described contents.

One end portion of the separation restricting part 600 may be connected to an inner surface of the base part 210.

The separation restricting part 600 may be connected to the inner surface of the base part 210 facing the third backplate part 133 to be concealed from the outside.

The other end portion of the separation restricting part 600 may be fastened to or separated from the major fastening part.

One end portion of the separation restricting part 600 may be fixed to the inner surface of the base part 210 under the through hole h211.

Figure 4:
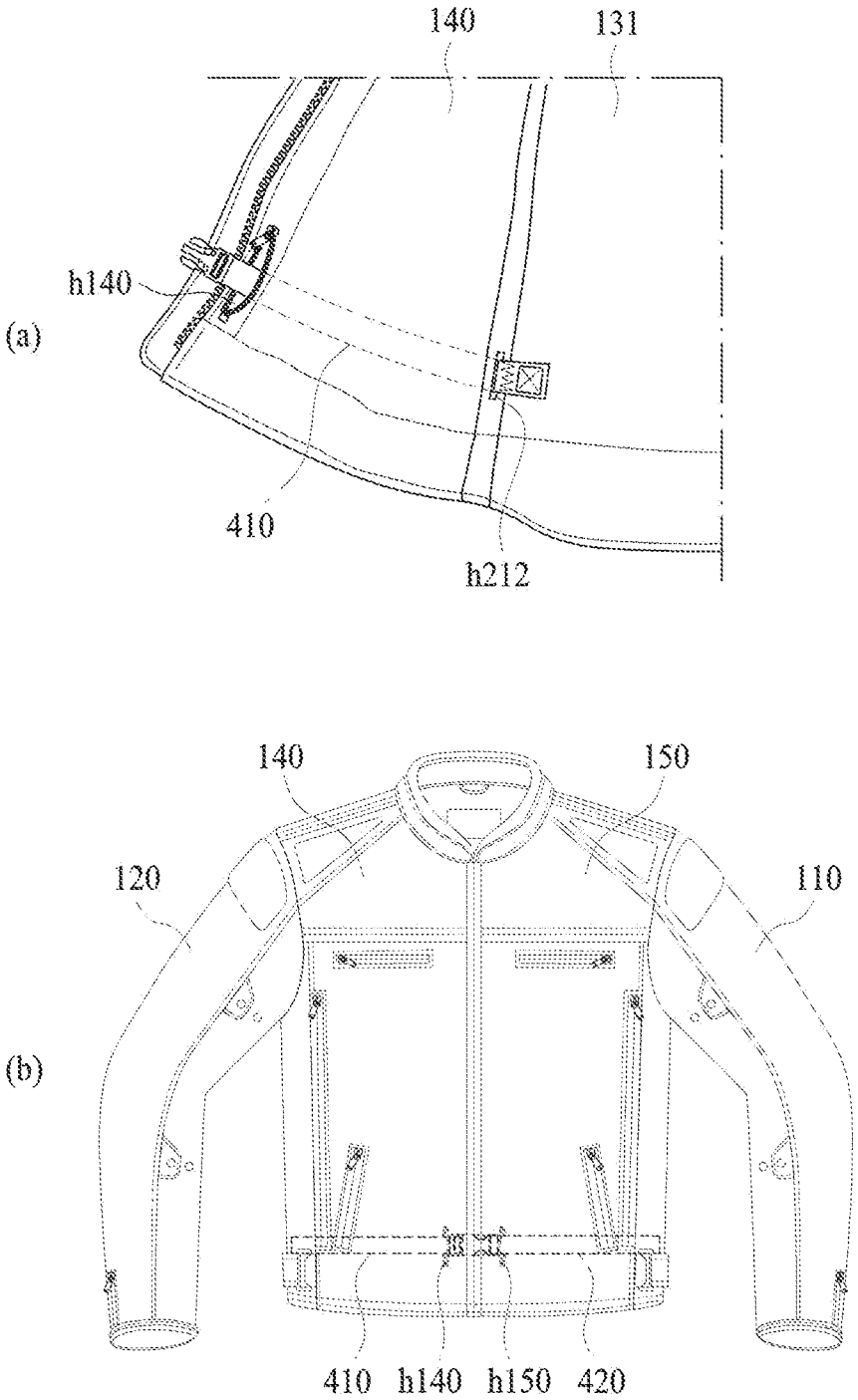
FIGS. 4A and 4B are views for describing a positional relationship between an external force providing part and a clothing part provided in the clothing according to an embodiment of the present disclosure.

FIGS. 4A and 4B are views for describing a positional relationship between the external force providing part and the clothing part provided in the clothing according to an embodiment of the present disclosure.

Referring to FIGS. 4A and 4B, the external force providing part 400 may include a first external force providing part 410, of which one end portion is connected to one side of an inner surface of the third backplate part 133, and a second external force providing part 420, of which one end portion is connected to the other side of the inner surface of the third backplate part 133, and the other end portion is detachable to the other end portion of the first external force providing part 410.

In a state in which the first external force providing part 410 and the second external force providing part 420 are coupled to each other, a length of the first external force providing part 410 may be varied, and a length of the second external force providing part 420 may be varied.

The clothing wearer may vary the length of each of the first external force providing part 410 and the second external force providing part 420 according to a body shape thereof. When the first external force providing part 410 and the second external force providing part 420 are coupled to each other, drooping of the third backplate part by a predetermined standard or more due to the object accommodated in the accommodation space S100 may be prevented.

One side insertion hole h145 into which the first external force providing part 410 is inserted may be formed in the right chest part 140 so that a middle end portion of the first external force providing part 410 having one end portion fixed to the inner surface of the third backplate part 133 may be concealed in the right chest part 140 to minimize contact between the first external force providing part 410 and the human.

For this end, one end portion of the first external force providing part 410 may be fixed to the third backplate part 133 to be adjacent to the one side insertion hole h145.

As an example, the one side insertion hole h145 may be formed in a lower end of the third backplate part 133 and one side of the third backplate part 133.

Further, a right through hole h140 into which the first external force providing part 410 is inserted may be formed in the right chest part 140 so that the other end portion of the first external force providing part 410 may be exposed to the outside to be easily attached to and detached from the other end portion of the second external force providing part 420 in a state in which one end portion of the first external force providing part 410 is fixed to the inner surface of the third backplate part 133 and the middle end portion of the first external force providing part 410 is concealed in the right chest part 140.

Accordingly, most of the first external force providing part 410 may be located in the clothing part 100, so that contact between the first external force providing part 410 and the wearer' body may be minimized, and wearing comfort may be improved.

Likewise, the other side insertion hole h155 into which the second external force providing part 420 is inserted may be formed in the left chest part 150 so that a middle end portion of the second external force providing part 420 having one end portion fixed to the inner surface of the third backplate part 133 may be concealed in the left chest part 150 to minimize contact between the second external force providing part 420 and the human.

For this end, one end portion of the second external force providing part 420 may be fixed to the third backplate part 133 to be adjacent to the other side insertion hole h155.

As an example, the other side insertion hole h155 may be formed in the lower end of the third backplate part 133 and the other side of the third backplate part 133.

Further, a left through hole h420 into which the second external force providing part 420 is inserted may be formed in the left chest part 150 so that the other end portion of the second external force providing part 420 may be exposed to the outside to be easily attached to and detached from the other end portion of the second external force providing part 420 in a state in which one end portion of the second external force providing part 420 is fixed to the inner surface of the third backplate part 133 and the middle end portion of the second external force providing part 420 is concealed in the left chest part 150.

Hereinafter, a process in which the accommodation space S100 moves from the storing position to the accommodation position will be described in detail.

Figure 5A:
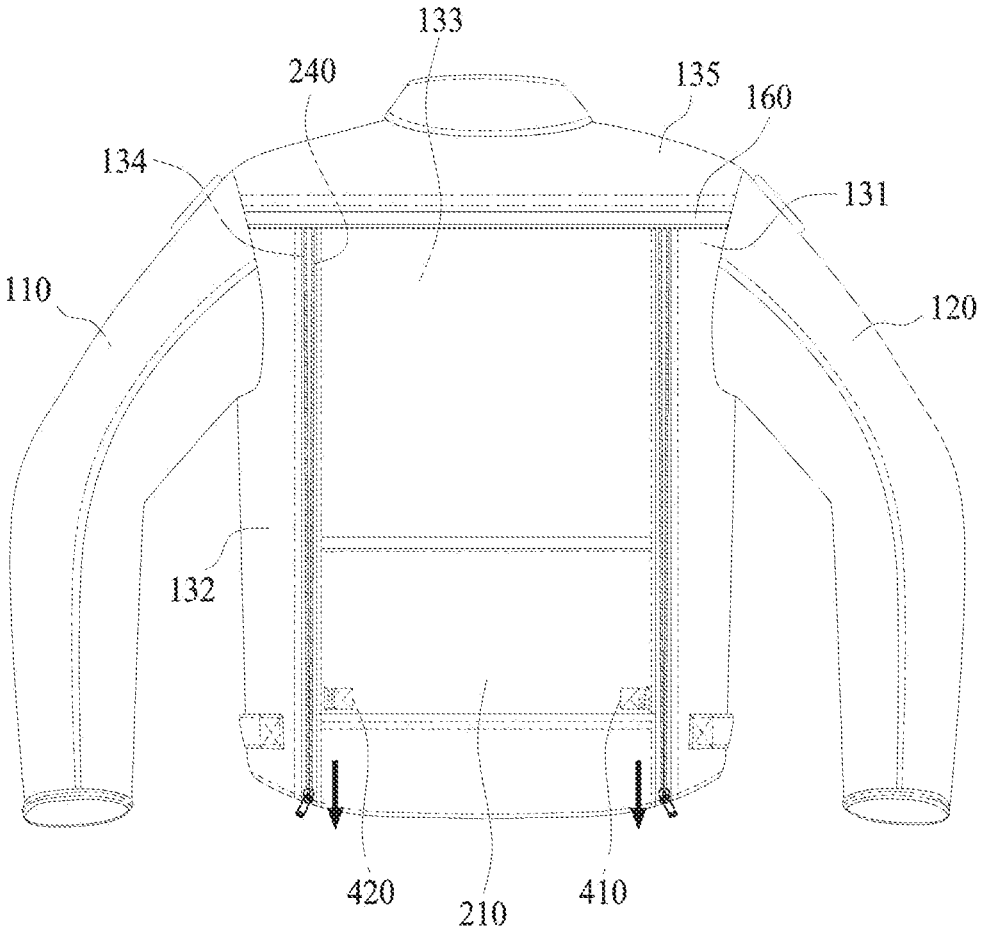
FIGS. 5A and 5B are views illustrating a state change of the clothing according to an embodiment of the present disclosure.
Figure 5B:
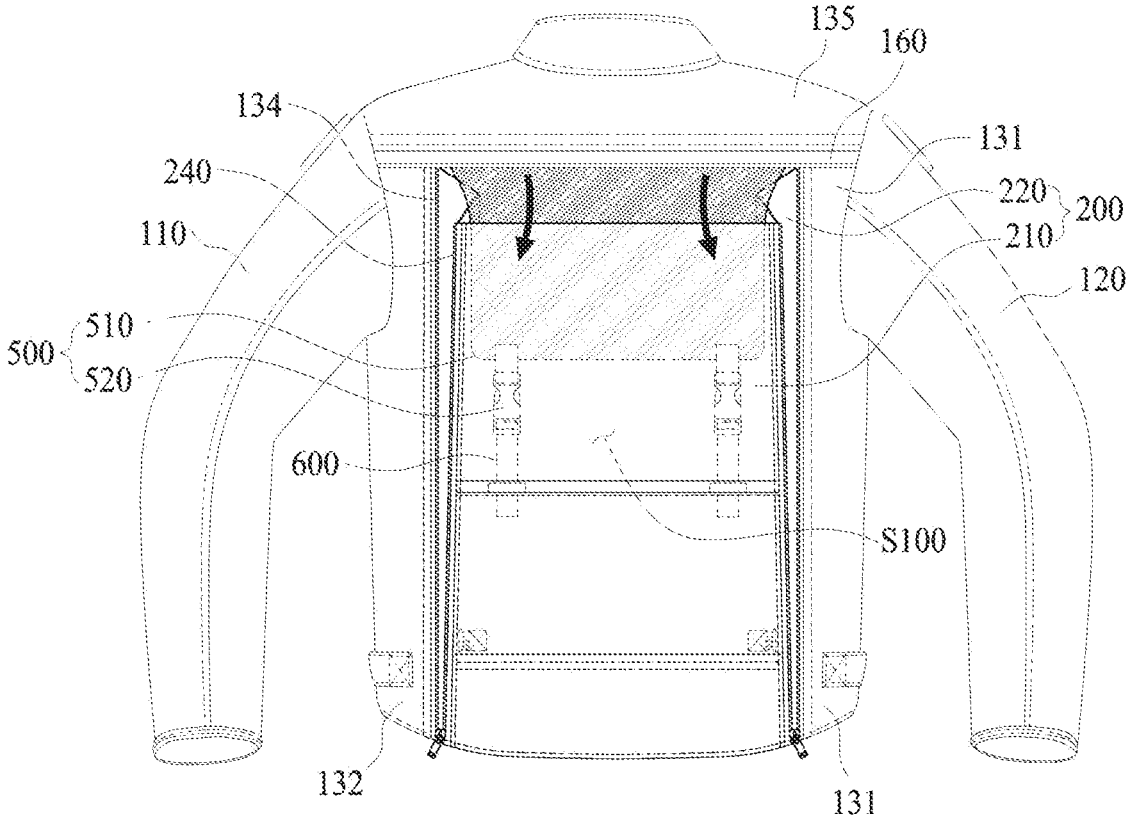

FIGS. 5A and 5B are views illustrating a state change of the clothing according to an embodiment of the present disclosure.

When the accommodation part 200 is in the storing position, the clothing coupling part 134 and the accommodation coupling part 240 may be coupled to each other.

When the accommodation part 200 is in the storing position, the accommodation coupling part 240 and the clothing coupling part 134 are coupled to each other, and thus the accommodation part 200 may form one surface together with the first backplate part 131 and the second backplate part 132.

As a specific example, the outer surface of the base part 210 may form one surface together with the first backplate part 131 and the second backplate part 132.

When the accommodation part 200 is in the storing position, the accommodation part 200 may partially come into close contact with the third backplate part 133.

As an example, the first space adjusting part 310 and the second space adjusting part 320 may be fastened to each other, and the first one side surface portion 221 and the second one side surface portion 222 may come into contact with each other.

In other words, the one side surface portion 220 is folded to come into close contact with the third backplate part 133 and the inner surface of the base part 210 at a space between the third backplate part 133 and the inner surface of the base part 210.

Likewise, the first other side surface portion 231 and the second other side surface portion 232 may come into contact with each other.

In other words, the other side surface portion 230 is folded to come into close contact with the third backplate part 133 and the inner surface of the base part 210 at the space between the third backplate part 133 and the inner surface of the base part 210.

When the accommodation part 200 is in the storing position, the one side surface portion 220 and the other side surface portion 230 may be disposed between the base part 210 and the third backplate part 133 to be concealed from the outside.

The separation restricting part 600 may be disposed between the third backplate part 133 and the base part 210 to come into close contact with the third backplate part 133 and the inner surface of the base part 210.

The major main body part 510 and the major fastening part 520 may be disposed between the third backplate part 133 and the base part 210 to come into close contact with the third backplate part 133 and the inner surface of the base part 210.

The first sub cover part 160 may cover a portion to which the major main body part 510 and the backplate part 130 are connected and the other end portion of the base part 210 to effectively prevent insertion of foreign substances into the space between the third backplate part 133 and the inner surface of the base part 210 when the accommodation part 200 is in the storing position.

Referring to FIG. 5A, the wearer may release coupling between the clothing coupling part 134 and the accommodation coupling part 240 to insert the predetermined object into the accommodation space S100.

As an example, the zipper may be lowered in a downward direction.

Referring to FIG. 5B, the wearer may separate the first space adjusting parts 310 (see FIG. 3) and the second space adjusting parts 320 (see FIG. 3).

When all first space adjusting parts 310 and the second space adjusting parts 320 are separated as shown in FIG. 5B, the size of the accommodation space S100 may be maximized.

Figure 6:
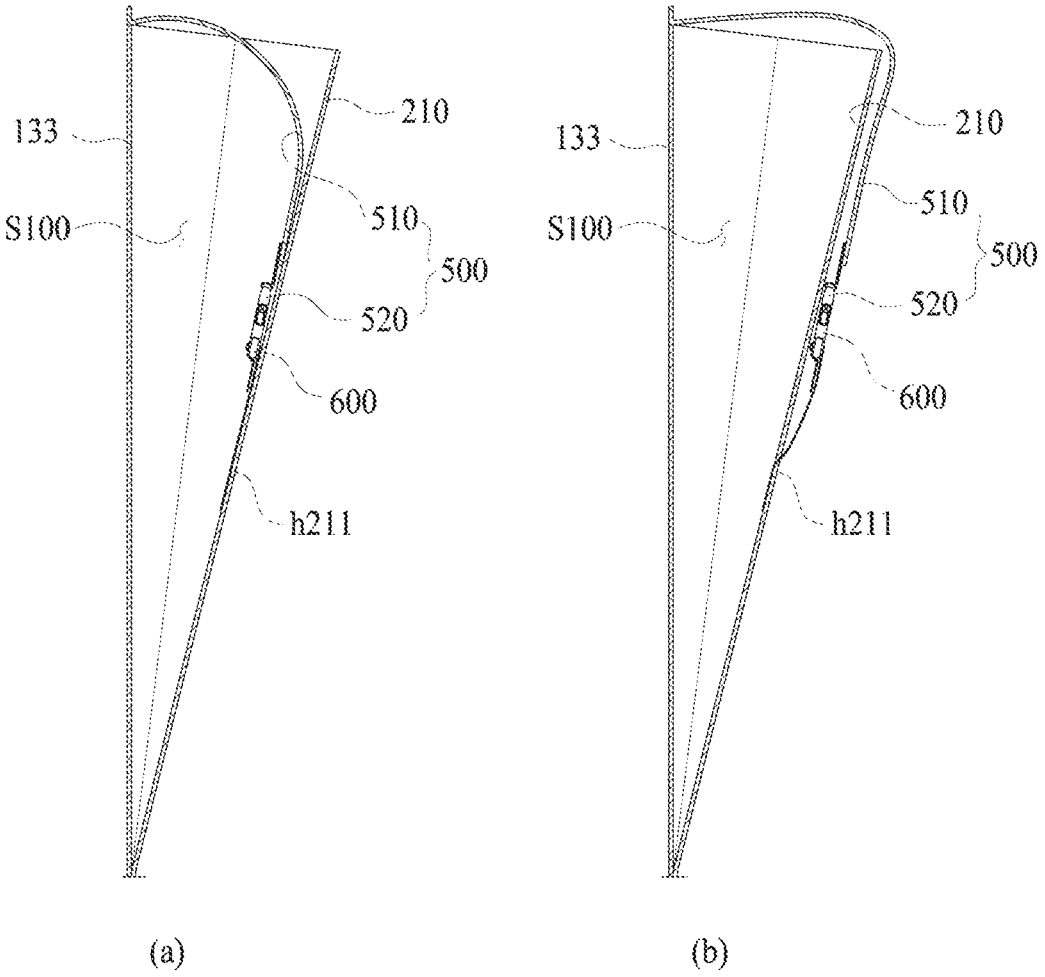
FIGS. 6A and 6B are views illustrating a state in which a main cover part and a separation restricting part provided in the clothing according to an embodiment of the present disclosure are coupled to each other.

FIGS. 6A and 6B are views illustrating a state in which the main cover part and the separation restricting part provided in the clothing according to an embodiment of the present disclosure are coupled to each other The wearer may couple the main cover part 500 to the separation restricting part 600 according to a purpose.

Referring to FIG. 6A, in a state in which the major main body part 510 is at least partially disposed in the accommodation space S100, and the separation restricting part 600 is entirely disposed in the accommodation space S100, the separation restricting part 600 and the major fastening part 520 may be coupled to each other.

The above may be used when the object loaded in the accommodation space S100 occupies a small space of the accommodation space S100.

In this case, the major main body part 510 may not entirely surround the opening.

In this case, an outer surface of the major main body part 510 may come into contact with the inner surface of the base part 210.

On the other hand, referring to FIG. 6B, the separation restricting part 600 passes through the through hole h211, and thus a portion of the separation restricting part 600 is disposed in the accommodation space S100 and the remaining portion of the separation restricting part 600 is exposed to the outside, and in a state in which the major main body part 510 entirely surrounds the opening, the separation restricting part 600 and the major fastening part 520 may be coupled to each other.

The above may be used when the object loaded in the accommodation space S100 occupies most space of the accommodation space S100.

The term "opening" may mean a predetermined space provided by the other end of the base part 210, an upper end of the third backplate part 133, an upper end of the one side surface portion 220, and an upper end of the other side surface portion 230.

The through hole h211 which is a predetermined hole may be formed in the base part 210 to partially dispose the separation restricting part 600 at the outside so that a portion of the main cover part 500 may surround the opening to partially include the outer surface of the base part 210 opposite the inner surface of the base part 210.

When the accommodation part 200 is in the accommodation position, since the accommodation coupling part 240 and the clothing coupling part 134 are separated from each other, the accommodation part 200 may provide the accommodation space S100 together with the third backplate part 133.

The wearer may surely couple the separation restricting part 600 and the major fastening part 520 not to use the accommodation part, and may use the accommodation part as shown in FIG. 5B.

Referring to FIGS. 1A, 1B, 2, and 3, when the accommodation part 200 is in the accommodation position, the base part 210 may be disposed to be connected to the third backplate part 133 so that one end portion of the base part 210 may be fixed to the third backplate part 133 and the other end portion of the base part 210 may be spaced apart from the third backplate part 133, and thus a separation distance between the base part 210 and the third backplate part 133 may gradually increase from one end portion of the base part 210 toward the other end portion of the base part 210.

Figure 7:
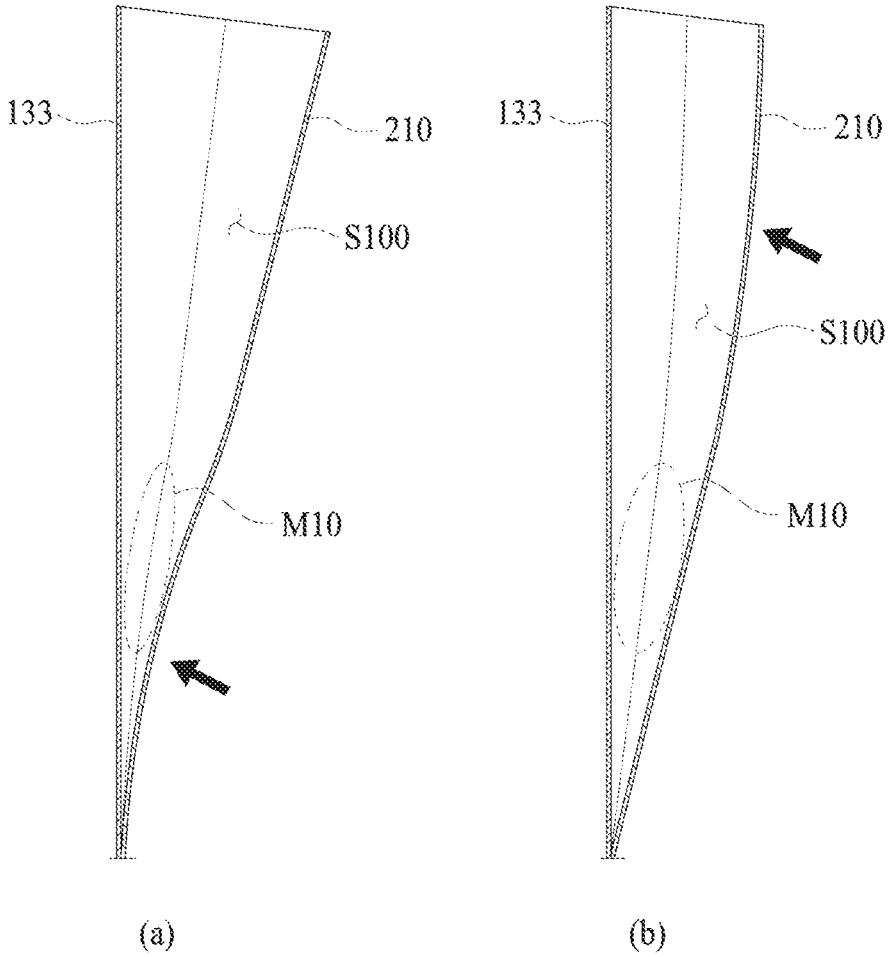
FIGS. 7A and 7B are views illustrating a use example of the clothing according to an embodiment of the present disclosure.

FIGS. 7A and 7B are views illustrating a use example of the clothing according to an embodiment of the present disclosure.

Configurations except the third backplate part 133 and the base part 210 are omitted in FIGS. 7A and 7B for an easy description.

The wearer may couple or separate the space adjusting part 300 to deform the accommodation space S100 according to the purpose.

The space adjusting part 300 (see FIG. 3) connected to the one side surface portion 220 (see FIG. 3) and the other side surface portion 230 (see FIG. 3) may be plural.

As a specific example, the number of the space adjusting part connected to the one side surface portion may be two, and the number of the space adjusting part 300 connected to the other side surface portion 230 may be two.

With reference to the other side surface portions 231 and 232 (see FIG. 3), referring to FIG. 7A, the wearer may couple the first space adjusting part 310 (see FIG. 3) and the second space adjusting part 320 (see FIG. 3) which exist at a lower side, and separate the first space adjusting part 310 and the second space adjusting part 320 which exist at an upper side.

In this case, when a very small object M10 is disposed in the accommodation space S100, separation of the object from the accommodation space S100 through the opening may be prevented.

That is, when the first space adjusting part and the second space adjusting part at the lower side are coupled to each other, the separation distance between the base part and the third backplate part may further decrease in comparison with the case in which the first space adjusting part and the second space adjusting part at the lower side are not coupled to each other.

On the contrary, referring to FIG. 7B, the wearer may separate the first space adjusting part 310 and the second space adjusting part 320 which exist at the lower side, and couple the first space adjusting part 310 and the second space adjusting part 320 which exist at the upper side.

In this case, when a small object M20 is disposed in the accommodation space S100, separation of the object from the accommodation space S100 through the opening may be prevented.

That is, when the first space adjusting part and the second space adjusting part at the lower side are coupled to each other, the separation distance between the base part and the third backplate part may further decrease in comparison with the case in which the first space adjusting part and the second space adjusting part at the lower side are not coupled to each other.

In other words, the wearer may prevent separation of the object, accommodated in the accommodation space S100 through the space adjusting part 300, in addition to the main cover part 500, and may adjust step by step the size of the accommodation space S100 corresponding to the object accommodated in the accommodation space S100 through the space adjusting part 300.

In clothing according to the present disclosure, a backpack can be used even while the clothing is worn.

Further, convenience of a user can increase.

In addition, loss of natural functions of the clothing can be prevented.

However, effects of the present disclosure are not limited to the above-described effects and unmentioned effects may be apparently understood by those skilled in the art from the specification and the accompanying drawings.

The accompanying drawings shows simply or omits configurations not related to or less related to the spirit of the present disclosure to more apparently show the technical spirit of the present disclosure.

In the above, although the configurations and the characteristics of the present disclosure are described with respect to the embodiment of the present disclosure, the present disclosure is not limited thereto, it is apparent that various changes and modifications may be performed by those skilled in the art in the spirit and the scope of the present disclosure, and accordingly, the above-described changes or modifications are within the accompanying claims.

What is claimed is:

1. Clothing comprising:

a clothing part configured to surround a human body to protect the human body; and an accommodation part connected to the clothing part and configured to provide an accommodation space which is a predetermined space in which a predetermined object is received, wherein the accommodation part forms one surface together with the clothing part as an accommodation coupling part which is a part of the accommodation part is coupled to a clothing coupling part which is a part of the clothing part in a storing position, and provides the accommodation space which is a space in which a predetermined object is received, together with the clothing part as the accommodation coupling part and the clothing coupling part are separated from each other and thus a portion of the clothing part and a portion of the accommodation part are spaced apart from each other in an accommodation position, the clothing part includes a left arm part providing a predetermined space into which a left arm of a wearer is insertable, a right arm part providing a predetermined space into which a right arm of the wearer is insertable, and a backplate part connected to the left arm part and the right arm part and configured to surround a back of a human, the backplate part includes a first backplate part providing a predetermined area, a second backplate part providing a predetermined area, a third backplate part disposed between the first backplate part and the second backplate part to be connected to the first backplate part and the second backplate part, and the clothing coupling part connected to a portion to which the first backplate part and the third backplate part are connected and a portion to which the second backplate part and the third backplate part are connected, and the accommodation part forms one surface together with the first backplate part and the second backplate part as the accommodation coupling part and the clothing coupling part are coupled to each other in the storing position, and provides the accommodation space together with the third backplate part as the accommodation coupling part and the clothing coupling part are separated from each other in the accommodation position.

2. The clothing of claim 1, wherein the accommodation part partially comes into close contact with the third backplate part in the storing position.

3. The clothing of claim 1, wherein:

the accommodation part includes a base part, one side surface portion connected to one side of the base part and one side of the third backplate part, the other side surface portion connected to the other side of the base part and the other side of the third backplate part, and the accommodation coupling part connected to the one side and the other side of the base part; and the one side surface portion and the other side surface portion are disposed between the base part and the third backplate part to be concealed from the outside when the accommodation part is in the storing position.

4. The clothing of claim 3, further comprising a space adjusting part connected to the one side surface portion or the other side surface portion to change the accommodation space according to a purpose of a user when the accommodation part is in the accommodation position, wherein the space adjusting part includes a first space adjusting part connected to the one side surface portion and a second space adjusting part spaced apart from the first space adjusting part and connected to the one side surface portion, and the first space adjusting part is detachable from the second space adjusting part to change the accommodation space according to the purpose of the user.

5. The clothing of claim 1, wherein:

the accommodation part includes a base part, one side surface portion connected to one side of the base part and one side of the third backplate part, the other side surface portion connected to the other side of the base part and the other side of the third backplate part, and the accommodation coupling part connected to the one side and the other side of the base part; and the base part is disposed so that one end portion of the base part is fixed to the third backplate part and the other end portion of the base part is spaced apart from the third backplate part so that a separation distance between the base part and the third backplate part gradually increases from the one end portion of the base part toward the other end portion of the base part when the accommodation part is in the accommodation position.

6. The clothing of claim 5, further comprising an external force providing part connected to the third backplate part to provide a pulling external force to the third backplate part so that drooping of the third backplate part due to the accommodation part is prevented when an object is accommodated in the accommodation space.

7. The clothing of claim 6, wherein the external force providing part includes a first external force providing part of which one end portion is connected to one side of an inner surface of the third backplate part, and a second external force providing part of which one end portion is connected to the other side of the inner surface of the third backplate part and the other end portion is detachable from the other end portion of the first external force providing part.

8. The clothing of claim 7, wherein:

the clothing part further includes a right chest part connected to the right arm part and one side of the backplate part to surround one side of a chest and a belly of the human; and one side insertion hole into which the first external force providing part is inserted is formed in the right chest part so that a middle end portion of the first external force providing part having one end portion fixed to the inner surface of the third backplate part is concealed in the right chest part to minimize contact between the first external force providing part and the human.

9. The clothing of claim 8, wherein a right through hole into which the first external force providing part is inserted is formed in the right chest part so that the other end portion of the first external force providing part is exposed to the outside to be easily attached to and detached from the other end portion of the second external force providing part in a state in which the one end portion of the first external force providing part is fixed to the inner surface of the third backplate part and the middle end portion of the first external force providing part is concealed in the right chest part.

10. The clothing of claim 1, further comprising a main cover part connected to the third backplate part and configured to surround an opening of the accommodation part opened in one direction so that a predetermined object accommodated in the accommodation space is concealed from the outside in a state in which the accommodation part is in the accommodation position, wherein the accommodation part includes a base part, one side surface portion connected to one side of the base part and one side of the third backplate part, the other side surface portion connected to the other side of the base part and the other side of the third backplate part, and the accommodation coupling part connected to the one side and the other side of the base part, and the main cover part is disposed between the base part and the third backplate part to be concealed from the outside when the accommodation part is in the storing position.

11. The clothing of claim 10, wherein the clothing part further includes a first sub cover part having one end portion connected to the third backplate part to surround the other end portion of the base part, when the accommodation part is in the storing position, so that the other end portion thereof is freely movable.

12. The clothing of claim 11, further comprising a separation restricting part couplable to the main cover part to prevent separation of the main cover part from the base part by a predetermined distance or more when the main cover part surrounds the opening of the accommodation part, wherein the separation restricting part is connected to an inner surface of the base part facing the third backplate part to be concealed from the outside.

13. The clothing of claim 12, wherein a through hole which is a predetermined hole is formed in the base part so that a portion of the separation restricting part is disposed at the outside and a portion of the main cover part surrounds the opening of the accommodation part to partially include an outer surface of the base part opposite the inner surface of the base part.

* * * * *